US009375630B2

(12) United States Patent
Pegolo et al.

(10) Patent No.: US 9,375,630 B2
(45) Date of Patent: Jun. 28, 2016

(54) TOE PIECE OF A BINDING FOR SHOES, WITH A SELF-ALIGNING MAGNETIC SYSTEM

(75) Inventors: Luca Pegolo, Turin (IT); Fulvio Tosco, Turin (IT)

(73) Assignees: ELMI S.r.l., Beinasco, Turin (IT); Luca Pegolo, Turin (IT)

( * ) Notice: Subject to any disclaimer, the term of this patent is extended or adjusted under 35 U.S.C. 154(b) by 207 days.

(21) Appl. No.: 14/131,130

(22) PCT Filed: Jul. 6, 2012

(86) PCT No.: PCT/IB2012/053466

§ 371 (c)(1),
(2), (4) Date: Jan. 6, 2014

(87) PCT Pub. No.: WO2013/005191

PCT Pub. Date: Jan. 10, 2013

(65) Prior Publication Data

US 2014/0137439 A1 May 22, 2014

(30) Foreign Application Priority Data

Jul. 7, 2011 (IT) ..... TO2011A0598

(51) Int. Cl.
*A63C 9/00* (2012.01)
*A43B 1/00* (2006.01)
(Continued)

(52) U.S. Cl.
CPC ..... *A63C 9/00* (2013.01); *A43B 1/0054* (2013.01); *A43B 5/0413* (2013.01);
(Continued)

(58) Field of Classification Search
CPC .. A43B 5/0496; A43B 5/0423; A43B 5/0413; A43B 5/0417; A43B 1/0054; A63C 9/0802; A63C 9/0807; A63C 9/00; A63C 9/086; A63C 9/08521; B25B 23/12
USPC ..... 36/114; 280/617
See application file for complete search history.

(56) References Cited

U.S. PATENT DOCUMENTS 3,794,338 A * 2/1974 Smolka ..... A63C 9/08 280/629
4,113,277 A * 9/1978 Zoor ..... A63C 9/0805 280/626

(Continued)

FOREIGN PATENT DOCUMENTS

DE 26 49 296 A1 5/1978
DE 20 2010 006102 U1 8/2010

(Continued)

OTHER PUBLICATIONS

International Search Report for corresponding International Patent Application No. PCT/IB2012/053466 mailed Sep. 19, 2012.

*Primary Examiner* — Brodie Follman
*Assistant Examiner* — Brian Cassidy
(74) *Attorney, Agent, or Firm* — Merchant & Gould P.C.

(57) ABSTRACT

A toe piece (10) of a binding for shoes includes a support base (11) provided with a pair of jaws (13) arranged on opposite sides of the support base (11) and provided with respective pins (15), which extend transversely inwards and are adapted to engage respective seats (21) of metal material arranged in the toe of a footwear item (SB). The support base is further provided with an actuating system (17) operable for actuating the jaws to close or open for respectively locking or releasing the toe of the footwear item (SB). At least one of the pins has at least one portion of magnetized material, configured so that, when the toe of the footwear item (SB) is brought close to the jaws (13) in an open position, at least one of the jaws is urged by magnetic attraction of the respective pin (15) towards the respective seat (21) on the footwear item (SB), without operation of the actuating system (17).

4 Claims, 3 Drawing Sheets

(51) Int. Cl.

| | |
|---|---|
| ***A43B 5/04*** | (2006.01) |
| ***A63C 9/08*** | (2012.01) |
| ***A63C 9/085*** | (2012.01) |
| ***A63C 9/086*** | (2012.01) |

(52) U.S. Cl.
CPC ..... *A43B 5/0417* (2013.01); *A43B 5/0423* (2013.01); *A63C 9/0802* (2013.01); *A63C 9/086* (2013.01); *A63C 9/0807* (2013.01); *A63C 9/08521* (2013.01)

(56) References Cited

U.S. PATENT DOCUMENTS 4,348,036 A * 9/1982 Settembre ..... A63C 9/0807 280/615
4,657,278 A * 4/1987 Klubitschko ..... A63C 9/0802 280/612
4,907,817 A * 3/1990 Schwarz ..... A63C 9/20 280/615
4,920,665 A * 5/1990 Pack ..... A43B 5/0492 280/613
6,299,192 B1 10/2001 Bryce
6,356,176 B1 * 3/2002 Anderson ..... H01F 13/00 206/350
6,375,212 B1 * 4/2002 Hillairet ..... A63C 10/10 280/617
6,684,740 B2 * 2/2004 Lin ..... B25B 23/12 81/177.2
6,698,319 B2 * 3/2004 Huang ..... B25B 23/12 81/438
6,964,428 B2 * 11/2005 Quellais ..... A43B 5/0413 280/613
7,107,882 B1 * 9/2006 Chang ..... B25B 23/12 81/125
7,111,865 B2 * 9/2006 Girard ..... A43B 5/0413 280/613
7,510,207 B2 * 3/2009 Resch ..... A63C 9/005 280/14.22
7,788,997 B2 * 9/2010 Kozak ..... B25B 15/02 81/451
7,895,774 B2 * 3/2011 Pawsey ..... A43B 1/0054 36/112
8,439,389 B2 * 5/2013 Moore ..... A63C 7/12 280/11.33
8,534,697 B2 * 9/2013 Lengel ..... A63C 9/06 280/617
8,544,869 B2 * 10/2013 Lehner ..... A63C 9/0807 280/611
8,590,177 B1 * 11/2013 Quaeck ..... A43B 5/002 36/132
8,720,909 B2 * 5/2014 Hu ..... B25B 15/001 279/128
8,746,728 B2 * 6/2014 Shute ..... A63C 7/1013 280/607
8,746,729 B2 * 6/2014 Convert ..... A63C 9/10 280/613
8,793,905 B2 * 8/2014 Barthel ..... A43B 5/0423 36/115
8,807,586 B2 * 8/2014 Lehner ..... A63C 9/0807 280/611
8,894,087 B2 * 11/2014 Barthel ..... A63C 9/0807 280/614
9,016,712 B2 * 4/2015 Giordani ..... A63C 9/006 280/614
9,022,410 B2 * 5/2015 Giordani ..... A63C 9/006 280/614
9,039,030 B2 * 5/2015 Chickering-Ayers .. A63C 9/003 280/11.3
9,039,031 B2 * 5/2015 Soldan ..... A63C 9/0807 280/607
9,120,002 B2 * 9/2015 Barthel ..... A63C 9/006
2001/0029684 A1 * 10/2001 Horn ..... A43B 1/0054 36/117.3
2004/0065176 A1 * 4/2004 Lin ..... B25B 23/12 81/125
2007/0234856 A1 * 10/2007 Liu ..... B25B 15/001 81/438
2009/0179403 A1 * 7/2009 Ekberg ..... A43B 5/0403 280/623
2010/0011918 A1 * 1/2010 Ray ..... B25B 23/12 81/451
2010/0257754 A1 * 10/2010 Trabucchi ..... A43B 5/0413 36/117.1
2011/0271557 A1 * 11/2011 Barthel ..... A43B 5/0423 36/117.1
2012/0124867 A1 * 5/2012 Heinrich ..... A43B 1/0054 36/136
2012/0227286 A1 * 9/2012 Parisotto ..... A43B 5/0494 36/117.1
2013/0087992 A1 * 4/2013 Ibach ..... A63C 9/22 280/626
2013/0207356 A1 * 8/2013 Barthel ..... A63C 9/0807 280/11.33
2013/0283643 A1 * 10/2013 Rosato ..... A43B 3/246 36/117.3
2013/0307252 A1 * 11/2013 Crema ..... A63C 7/1053 280/617
2013/0328289 A1 * 12/2013 Vailli ..... A63C 9/003 280/625
2014/0159345 A1 * 6/2014 Indulti ..... A63C 9/0805 280/614
2014/0239615 A1 * 8/2014 Rullier ..... A63C 9/0807 280/616

FOREIGN PATENT DOCUMENTS

EP 0 199 098 A2 10/1986
WO WO 2011/025376 A2 3/2011

* cited by examiner

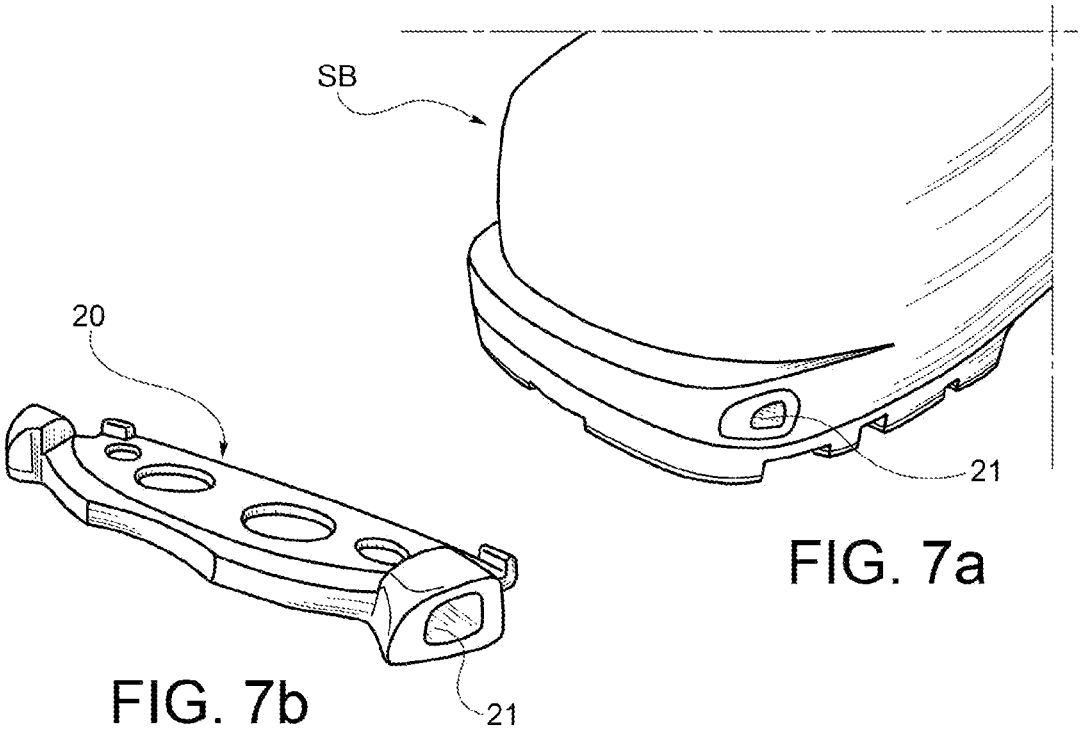
FIG. 7a
FIG. 7b
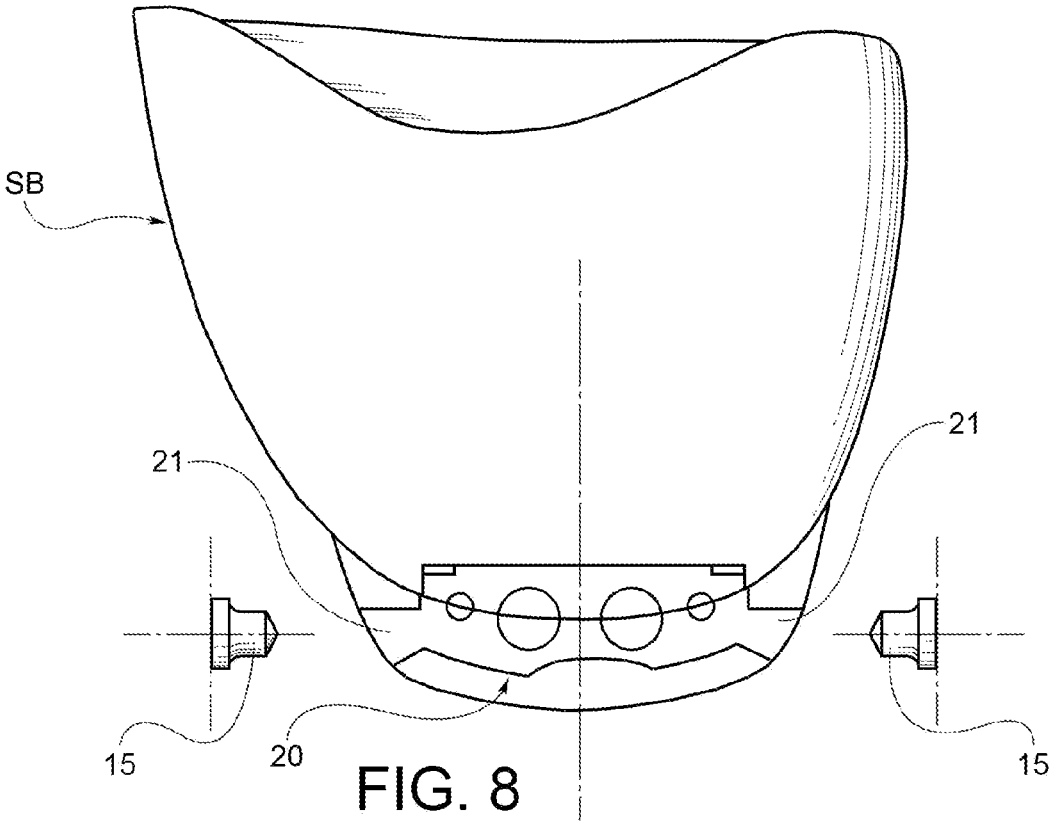
FIG. 8

TOE PIECE OF A BINDING FOR SHOES, WITH A SELF-ALIGNING MAGNETIC SYSTEM

This application is a National Stage Application of PCT/IB2012/053466, filed 6 Jul. 2012, which claims benefit of Serial No. TO2011A000598, filed 7 Jul. 2011 in Italy and which applications are incorporated herein by reference. To the extent appropriate, a claim of priority is made to each of the above disclosed applications.

BACKGROUND OF THE INVENTION

The present invention relates to a toe piece of a binding for shoes, comprising a support base provided with a pair of jaws arranged on opposite sides of the support base and provided with respective pins of metal material, which extend transversely inwards and are adapted to engage respective seats of metal material arranged in the toe of a footwear item, said support base being further provided with actuating means operable for actuating said jaws upon closing or opening, for respectively locking or releasing the toe of the footwear item.

It is known that, in the Alpine skiing technical field, there is the need to provide bindings comprising a front part or toe piece capable of locking the toe of a ski boot, allowing its rotation about a substantially horizontal axis, and a rear part or heel piece capable of cooperating with the boot heel to allow three different operative modes: free heel (normal progression), free heel with heel cushion (ascension progression), and locked heel (downhill).

A toe piece of the type defined at the beginning is described for example in EP 0 199 098.

A problem felt in relation to such bindings is related to the fact that it is necessary to correctly position the boot toe with respect to the toe piece jaws, so that the seats on such toe are correctly aligned with the closure trajectory of the pins. A positioning error of the boot can force the user to reopen the jaws to perform again the closing procedure. This can be problematic on an uneven ground or steep slopes, especially when the user does not have adequate experience.

SUMMARY OF THE INVENTION

Therefore, an object of the present invention is to provide a system that allows facilitating a proper and quick positioning of the boot toe with respect to the jaws, in order to allow carrying out a rapid locking procedure of the binding.

Such an object is achieved according to the invention by a toe piece of a binding of the type defined at the beginning, wherein at least one of said pins has at least one portion of magnetized material, in such a way as that, when the toe of the footwear item is brought close to the jaws in open position, at least one of said jaws is urged by magnetic attraction of the respective pin towards the respective seat on the footwear item, without operation of the actuating means.

The magnetic attraction has essentially a function of driving or invitation for the correct mutual positioning of the pin and the respective seat. More particularly, such attraction causes the pin to be attracted towards the respective seat, so that the former is induced to enter the latter, possibly causing an approaching movement of the jaw towards the boot toe, and carrying out in any case a temporary pre-lock coupling (that is unstable, i.e., without clamping of the jaws) that allows performing a proper locking of the boot toe when the actuating means are operated to actuate in closure the jaws.

Of course, it is not necessary that only the pin is of magnetized material. Alternatively, the respective seat can be of a magnetized material, or both the pin and the seat can be of a magnetized material.

Therefore, it is the object of the invention also a binding plate adapted to be arranged in the toe of a footwear item, said plate having a pair of seats arranged on opposite sides of the plate and adapted to be engaged by respective pins of metal material respectively arranged on a pair of jaws of a toe piece of a binding, wherein at least one of said seats has at least one portion of magnetized material, in such a way as that, when the toe of the footwear item is brought close to the jaws in open position, at least one of said jaws is urged by magnetic attraction of the respective pin towards the respective seat on the plate.

The invention relates particularly to Alpine skiing and similar activities on skis and snowshoes that take advantage of the presence of the free heel; however, it is not to be meant as limited to these, being able to be applied in any field that use jaw binding for a footwear item.

BRIEF DESCRIPTION OF THE DRAWINGS

Further characteristics and advantages of the toe piece of a binding for shoes according to the invention will become more apparent by virtue of the following detailed description of an embodiment of the finding, given with reference to the accompanying drawings, given by way of non-limiting illustrative example only, in which:

FIG. 7*a* is a perspective view of the toe of a ski boot;

FIG. 7*b* is a perspective view of a plate provided with binding seats, adapted to be embedded in the toe of a boot; and FIG. 8 is a plan view of the toe of a boot, with the binding seats ready to be coupled with respective pins.

DETAILED DESCRIPTION OF THE PREFERRED EMBODIMENTS

Figure 1:
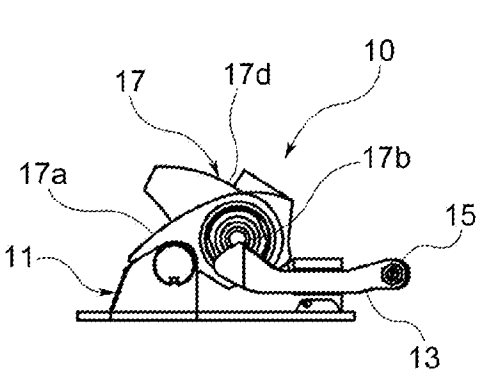
FIGS. 1 and 2 are a side elevation and a plan view, respectively, of a toe piece according to the invention, in particular a toe piece for ski or snowshoe binding.
Figure 2:
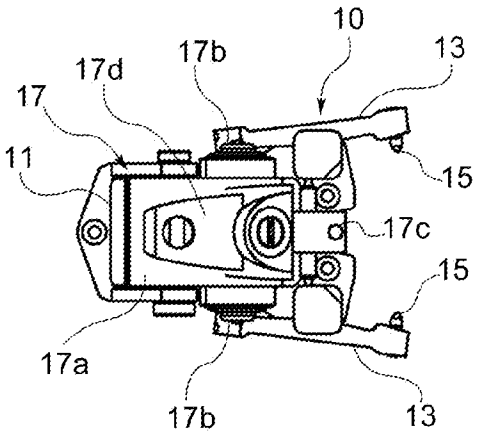

With reference to FIGS. 1 and 2, a toe piece for a ski or snowshoe binding is generally indicated with 10. In the following, reference will be made by sake of simplicity to such specific application of the invention; however, it is understood that the present invention may also find use in other fields.

The toe piece 10 comprising a support base 11 adapted to be secured on a ski or snowshoe (not shown). Such support base 11 is provided with a pair of jaws 13 arranged on opposite sides of the support base 11, with respect to the longitudinal direction of the latter. Each jaw 13 is composed of a rocker arm rotatably mounted on the support base 11 around a respective vertical axis, substantially perpendicular to the support base 11. The rotational axis of each jaw is arranged approximately in the proximity of a midpoint thereof.

Each jaw 13 is provided with a respective pin 15 at a rear end thereof, which pin transversally extends inwards and is adapted to engage a respective seat 21 of metal material (see FIGS. 7 and 8) arranged in the toe of a ski boot SB.

The support base 11 is further provided with actuating means 17 operable for actuating the jaws 13 upon closing or opening for respectively locking or releasing the toe of the boot. In the illustrated example, the actuating means 17 comprise an actuating block 17*a* rotatably mounted on the support base 11 around an axis perpendicular to the longitudinal direction of the toe piece 11. The actuating block 17*a* comprises on opposite sides respective actuating projections 17*b*, each of which is adapted to press against the front end of a respective jaw 13. The actuating block 17*a* is further provided with a control lever 17*c*, adapted to be engaged, manually or by the toe of a ski pole (not illustrated) to snap upon lowering the actuating block 17*a*, and with a control portion 17*d*, adapted to be engaged, manually or by the toe of a ski pole (not illustrated) to manoeuvre upon lifting the actuating block 17*a*. First elastic means (not illustrated) are further provided, which are adapted to urge upon lowering the actuating block 17*a* with respect to the support base 11, and second elastic means (not illustrated) adapted to transversally urge outwardly the actuating projections 17*b* of the actuating block 17*a*.

Figure 5:
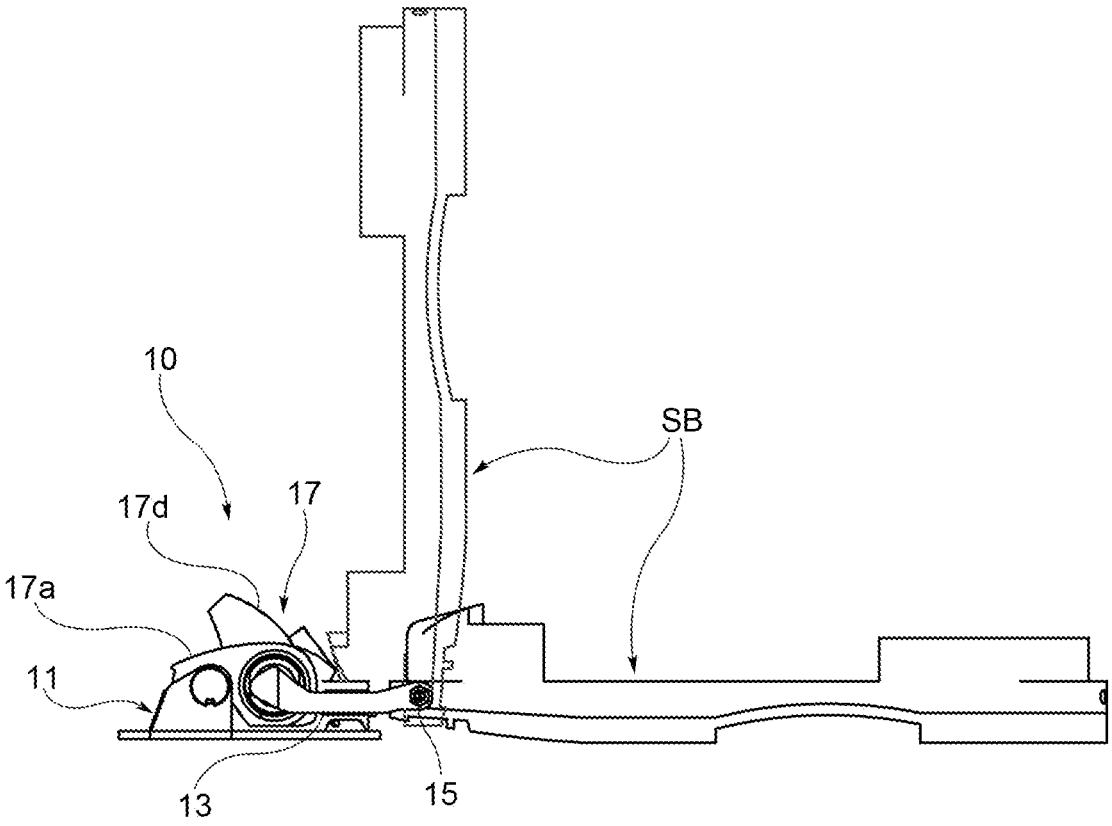
FIGS. 5 and 6 are a side elevation and a plan view, respectively, of the toe piece of FIGS. 1 and 2 with a boot, in a locking position.
Figure 6:
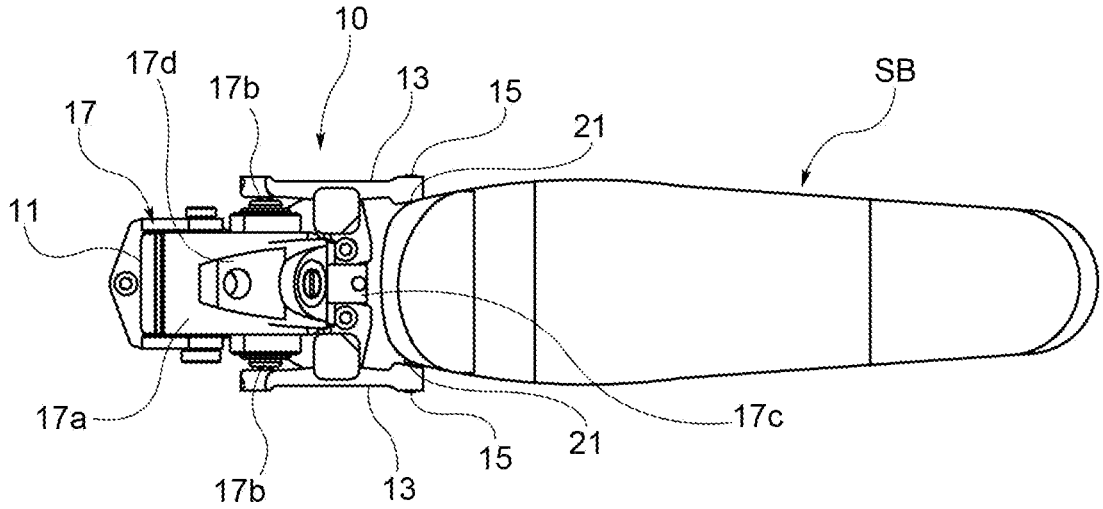

By pushing, manually or with a ski pole, on the control lever 17*c* of the actuating block 17*a*, causes the downward rotation of the actuating block 17*a*, which is wedged between the front ends of the jaws 13. Therefore, the actuating projections 17*b* urge outwards the front ends of the jaws 13, the rear ends of which consequently approach to one another, thus reaching the closure position (see FIGS. 5 and 6). The closure of the jaws 13, and therefore of the pins 15, allows conventionally implementing a rotational axis for the boot, as illustrated in FIG. 5.

The above-described arrangement of the jaws and the actuating means has been illustrated by way of example only, and it is not intended as a mandatory feature of the present invention. For example, the jaws could be arranged according to different modes, for example, with rotational axes parallel to the longitudinal axis of the support base, as in the binding described in EP 0199098, and also the mechanism could correspond to that described in such publication.

Figure 3:
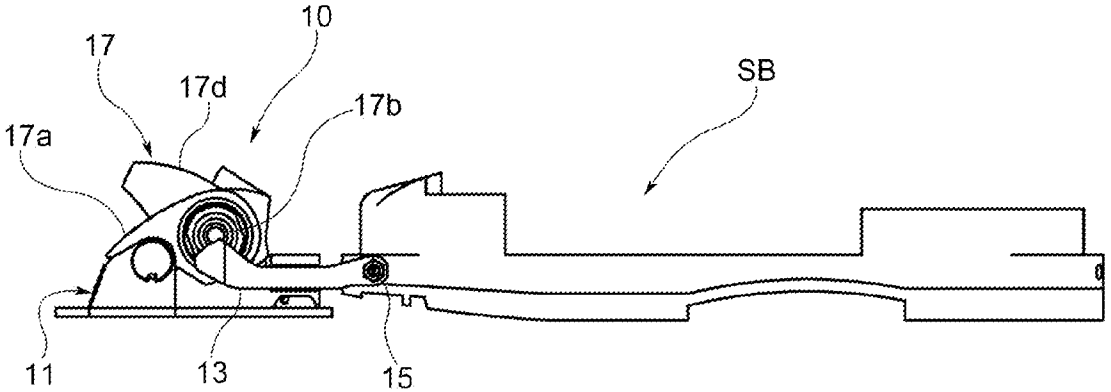
FIGS. 3 and 4 are a side elevation and a plan view, respectively, of the toe piece of FIGS. 1 and 2 with a boot, in a pre-locking position, obtained by a magnetic system.
Figure 4:
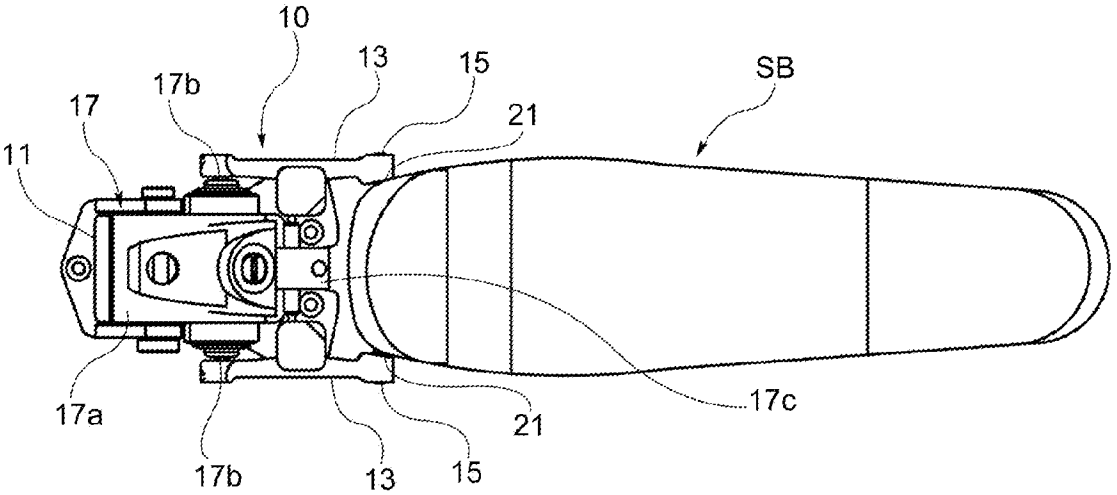

At least one of (preferably both) the pins 15 of the jaws 13 has at least one portion of magnetized material, in such a way as that, when the toe of the boot is brought close to the jaws in open position (position illustrated in FIGS. 1, 2, and 8), at least one of the jaws 13 with the respective pin 15 is urged by magnetic attraction between the pin 15 and the seat 21 towards the respective seat of the boot, reaching the position illustrated in FIGS. 3 and 4. Such pre-locking position is reached without the operation of the actuating means 17, and allows a centering of the pins with respect to the respective seats, that is preliminary to the locking operation of the boot toe carried out by actuating the actuating means 17. To this aim, it is necessary that the jaws in open position have some clearance or freedom of movement, or, in the case where elastic means acting of the jaws are provided for, also in open position, with forces opposing to the magnetic force, it is necessary that these opposing forces have a lower intensity than the magnetic force.

Alternatively or in combination, it is possible to provide that at least one of (preferably both) the seats 21 have at least one portion of magnetized material.

With reference to FIGS. 7 and 8, it is possible to note that the seats 21 are arranged on opposite sides of a binding plate 20 adapted to be arranged in the toe of a ski boot SB, for example, by co-moulding. In FIG. 8, the position of the binding plate 20 within the toe of the boot SB is highlighted.

The invention claimed is:

1. A toe piece of a binding for shoes, comprising: a support base provided with a pair of jaws arranged on opposite sides of the support base and provided with respective pins, which extend transversely inwards and are adapted to engage respective seats of metal material arranged in a toe of a footwear item, said support base being further provided with actuating means operable for actuating said jaws to close or open for respectively locking or releasing the toe of the footwear item, wherein at least one of said pins has at least one portion of magnetized material, configured so that, when the toe of the footwear item is brought close to the jaws in an open position, at least one of said jaws is urged by magnetic attraction of the respective pin towards the respective seat on the footwear item, without operation of the actuating means.

2. A toe piece according to claim 1, wherein each of said jaws comprises a rocker arm having a vertical rotation axis perpendicular to the longitudinal direction of said support base.

3. A plate adapted to be incorporated in a toe of a footwear item, said plate comprising: a pair of seats arranged on opposite sides of the plate and adapted to be engaged by respective pins of metal material respectively arranged on a pair of jaws of a toe piece of a binding, wherein at least one of said seats has at least one portion of magnetized material, configured so that, when the plate is brought close to the jaws in an open position, at least one of said jaws is urged by magnetic attraction of the respective pin towards the respective seat on the plate.

4. A footwear item incorporating the plate according to claim 3.

* * * * *